US008424339B2

(12) United States Patent
Sommer

(10) Patent No.: US 8,424,339 B2
(45) Date of Patent: Apr. 23, 2013

(54) METHOD AND SYSTEM FOR ROTOR COOLING

(75) Inventor: Steven T. Sommer, York, PA (US)

(73) Assignee: Johnson Controls Technology Company, Holland, MI (US)

( * ) Notice: Subject to any disclaimer, the term of this patent is extended or adjusted under 35 U.S.C. 154(b) by 364 days.

(21) Appl. No.: 12/745,593

(22) PCT Filed: Dec. 30, 2008

(86) PCT No.: PCT/US2008/088520

§ 371 (c)(1),
(2), (4) Date: Jun. 1, 2010

(87) PCT Pub. No.: WO2009/088846

PCT Pub. Date: Jul. 16, 2009

(65) Prior Publication Data

US 2010/0307191 A1 Dec. 9, 2010

Related U.S. Application Data

(60) Provisional application No. 61/017,966, filed on Dec. 31, 2007.

(51) Int. Cl.
*F25B 31/00* (2006.01)

(52) U.S. Cl.
USPC ..... 62/505; 62/510

(58) Field of Classification Search ..... 62/505, 62/510, 513, 498; 417/350, 366, 368; 310/54, 310/55, 58

See application file for complete search history.

(56) References Cited

U.S. PATENT DOCUMENTS

| | | | | |
|---|---|---|---|---|
| 6,065,297 | A * | 5/2000 | Tischer et al. | 62/84 |
| 6,070,421 | A | 6/2000 | Petrovich et al. | |
| 6,375,438 | B1 * | 4/2002 | Seo | 417/366 |
| 6,450,781 | B1 * | 9/2002 | Petrovich et al. | 417/350 |
| 6,997,686 | B2 * | 2/2006 | Agrawal et al. | 417/350 |
| 7,181,928 | B2 * | 2/2007 | de Larminat | 62/505 |
| 7,439,702 | B2 * | 10/2008 | Smith et al. | 318/701 |
| 7,451,616 | B2 * | 11/2008 | Ro | 62/505 |
| 7,631,510 | B2 * | 12/2009 | Radermacher et al. | 62/196.2 |
| 2005/0284173 | A1 * | 12/2005 | de Larminat | 62/505 |
| 2006/0083626 | A1 * | 4/2006 | Manole | 417/245 |
| 2007/0212232 | A1 | 9/2007 | De Larminat | |

FOREIGN PATENT DOCUMENTS

WO 9429597 12/1994

* cited by examiner

*Primary Examiner* — Mohammad Ali

(74) *Attorney, Agent, or Firm* — McNees Wallace & Nurick LLC

(57) ABSTRACT

A motor coolant method and system is used to cool a compressor motor (36) in a refrigeration system having a multi-stage compressor (38). The compressor includes a first compressor stage (42) and a second compressor stage (44), the first compressor stage providing compressed refrigerant to an input of the second compressor stage. The motor coolant system has a first connection with the refrigerant loop to receive refrigerant into the motor cavity for cooling, the received refrigerant provided from a system component having a high pressure, and a second connection with the refrigerant loop to return refrigerant to an intermediate pressure greater than an evaporator operating pressure. The pressure inside the motor cavity may be approximately the pressure within the first stage discharge and second stage suction to minimized seal leakage between the motor cavity and the internal pressures of the first and second stage compressors.

19 Claims, 6 Drawing Sheets

METHOD AND SYSTEM FOR ROTOR COOLING

This application claims the benefit of U.S. Provisional Application No. 61/017,966 entitled METHOD AND SYSTEM FOR ROTOR COOLING, filed Dec. 31, 2007, which is hereby incorporated by reference.

BACKGROUND

The application generally relates to a system and method of cooling compressor motors in vapor compression systems.

Hermetic motors may experience windage losses because of friction caused during rotation. Windage losses adversely impact motor performance and efficiency. To reduce windage losses in the motor, factors directly related to the motor, for example, the peripheral speed of the rotor, the flow and thermodynamic state conditions of motor cooling gas circulated around the motor, the rotor surface area and the roughness of the rotor surface may be controlled to reduce friction in the motor.

One method for reducing energy losses in motors while cooling the motor is by suctioning refrigerant toward the motor windings. The reduction in temperature caused by suctioning refrigerant across the motor windings prevents the motor components from overheating and increases motor operating efficiency. Another method for reducing energy losses in motors is to maintain a constant pressure throughout the motor cavity. A pressure valve can be placed within the motor cavity to release higher-pressure gas build up that occurs in the motor cavity during operation. As the pressure in the cavity increases, the valve opens, thereby releasing high-pressure gases. The maintenance of constant pressure in the cavity increases motor efficiency. However, this method uses mechanical equipment and is not optimal for maintaining a true constant pressure in the motor cavity. Additionally, this method does not address the issue of the motor cavity temperature.

An additional method controls energy losses in motors by maintaining a constant pressure in the motor cavity, while also preventing the oil losses between motor components. The preservation of oil in the motor bearing components allows for greater lubrication for the movement of parts thereby reducing friction while not allowing oil to escape into the motor cooling cavity, preventing excessive oil churning and reducing energy losses. A hermetically sealed housing containing the refrigeration compressor transmission and oil supply reservoir is connected to the suction side of the compressor to equalize the pressure in the housing. The focus of the method is to prevent the boiling of refrigerant from the oil reserve. However, this system only holds the pressure in the motor cavity at a constant level, and only assists in reducing energy losses, rather than optimizing the motor efficiency.

For very high speed motors however, windage losses can still be substantial even after factors such as the peripheral speed of the rotor, the density and flow of motor cooling gas around the motor, the rotor surface area and/or the roughness of the rotor surface are optimized. The only remaining factor that can be manipulated to reduce windage losses is the density of the gas in the motor cavity. Windage losses decrease as the density of the gas in the motor cavity decreases resulting in better motor efficiency.

To reduce the gas density in these higher-speed motor cavities, vacuum pumps are used to lower the pressure surrounding the motors to reduce windage losses as much as possible. However, the use of a vacuum pump does not provide the ability to both adequately cool the motor and provide a vacuum surrounding the motor cavity. One attempt to lower the gas density in the motor cavity while simultaneously cooling the motor involves the use of auxiliary positive displacement gas compressors powered by an independent power source to "pump down" the motor cavity while a complete vapor compression system is in operation. However the auxiliary compressors can consume more energy than is saved in motor windage losses.

Other conventional rotor cooling systems for hermetic/semi-hermetic motors in vapor compression systems rely on evaporator gas directed through the rotor and vented into the lowest pressure location at the impeller suction inlet to the compressor. The system is used to minimize the windage, or friction, loss of the rotor by maintaining the refrigerant density within the system near evaporator conditions. The windage loss in the motor is nearly directly proportional to the gas density in the motor cavity for a constant speed of the rotor.

A potentially undesirable result of using the lowest pressure gas for motor cooling to minimize motor losses is that the seal leakage in the compressor is actually maximized because the largest differential pressure across the seals are experienced. This argument applies to any seal vented through the motor cavity to first stage suction. The pressure upstream of the seal is at each respective impeller discharge static condition, and the downstream pressure is at motor cavity pressure—that is, near evaporator pressure—when utilizing evaporator vapor to cool the rotor. The system minimizes losses if the motor windage losses are the only consideration. However, by utilizing evaporator conditions for motor cooling, seal leakage in the compressor may increase, particularly within a two-stage compressor.

SUMMARY

The present invention relates to a vapor compression system. The vapor compression system includes a compressor, an evaporator and a condenser connected in a closed loop. A motor is connected to the compressor to power the compressor. A motor coolant system is configured to cool the compressor motor. The compressor includes a first compressor stage and a second compressor stage. The first compressor stage provides compressed vapor to an input of the second compressor stage. The motor coolant system includes a first connection in fluid communication with the closed loop to deliver refrigerant into a motor cavity, and a second connection with the refrigerant loop to return refrigerant to an interstage connection having an intermediate pressure. The intermediate pressure is greater than an evaporator operating pressure and less than a condenser operating pressure. A first seal is located between the motor cavity and the first compressor stage, and a second seal is located between the motor cavity and the second compressor stage. The first and second seal maintain the refrigerant at an intermediate pressure inside the motor cavity.

The present invention further relates to a motor coolant system for a motor powering a compressor in a chiller system. The chiller system includes a compressor, an evaporator and a condenser connected in a closed loop. The motor coolant system includes a motor housing enclosing the motor, and a motor cavity within the motor housing. The coolant system includes a first connection from the motor cavity in fluid communication with the condenser to deliver a refrigerant into the cavity, and a second connection from the motor cavity in fluid communication with the loop to return refrigerant to an interstage connection having an intermediate pressure. The intermediate pressure is greater than an evaporator operating pressure and less than a condenser operating pressure.

The motor cavity is configured to maintain the refrigerant at the intermediate pressure inside the motor cavity.

The present invention also relates to a motor coolant system for a motor powering a compressor in a chiller system, the chiller system comprising a compressor, an evaporator and a condenser connected in a closed loop. The motor coolant system includes a motor housing enclosing the motor, and a motor cavity within the motor housing. The coolant system includes a first connection from the motor cavity in fluid communication with the condenser to deliver a refrigerant into the cavity, and a second connection from the motor cavity in fluid communication with the loop to return refrigerant to the evaporator having a predetermined operating pressure. The motor cavity is configured to maintain the refrigerant at the evaporator operating pressure inside the motor cavity.

DETAILED DESCRIPTION OF THE EXEMPLARY EMBODIMENTS

Figure 1:
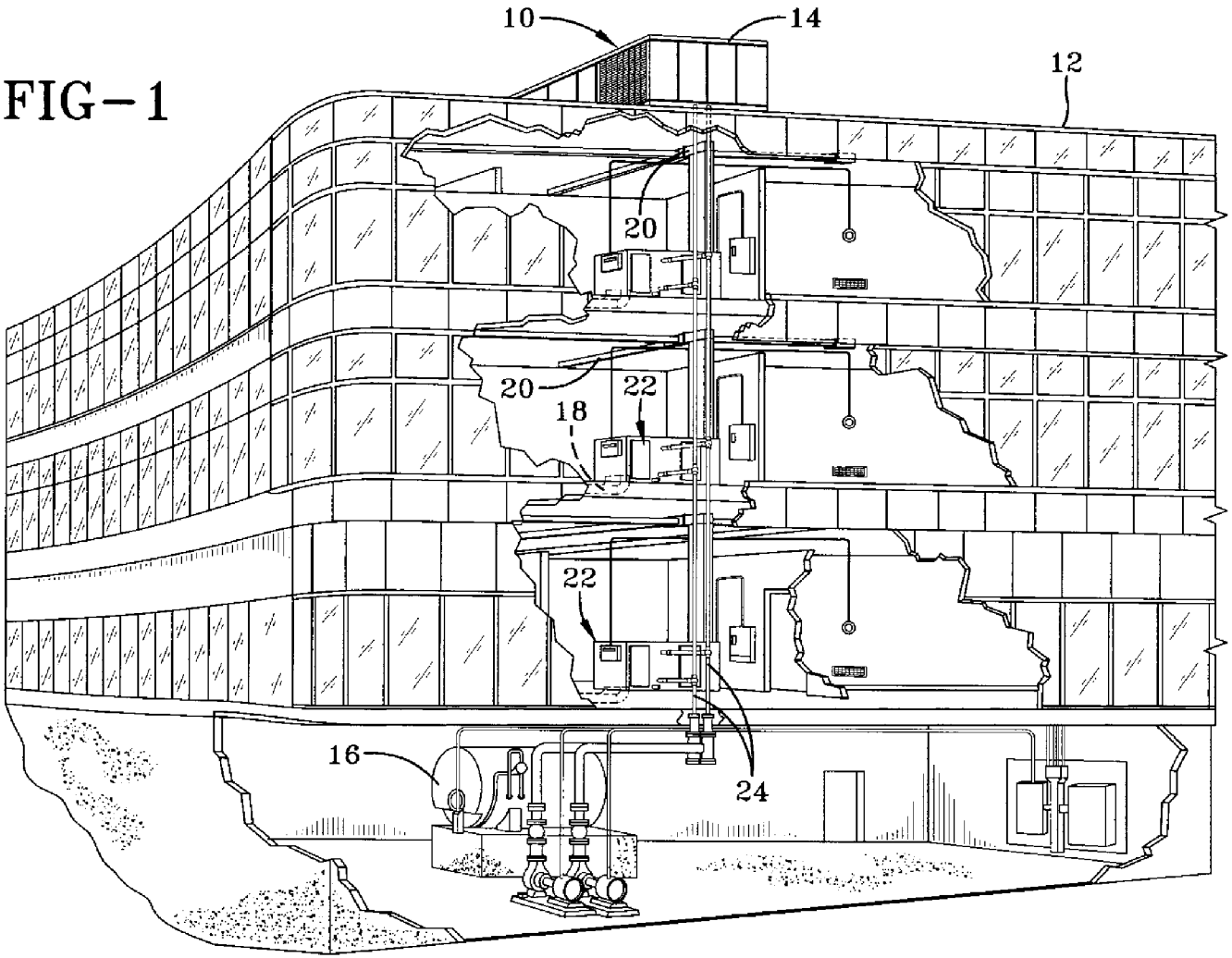
FIG. 1 shows an exemplary embodiment of a Heating, Ventilation and Air Conditioning (HVAC) system in a commercial environment.

FIG. 1 shows an exemplary environment for a Heating, Ventilating, Air Conditioning system (HVAC system) 10 in a building 12 for a commercial setting. System 10 may include a compressor incorporated into a vapor compression system 14 that can supply a chilled liquid that may be used to cool building 12. System 10 can also include a boiler 16 used to heat building 12, and an air distribution system that circulates air through building 12. The air distribution system can include an air return duct 18, an air supply duct 20 and an air handler 22. Air handler 22 can include a heat exchanger that is connected to boiler 16 and vapor compression system 14 by conduits 24. The heat exchanger in air handler 22 may receive either heated liquid from boiler 16 or chilled liquid from vapor compression system 14, depending on the mode of operation of system 10. System 10 is shown with a separate air handler on each floor of building 12, but it will be appreciated that these components may be shared between or among floors.

Figure 2:
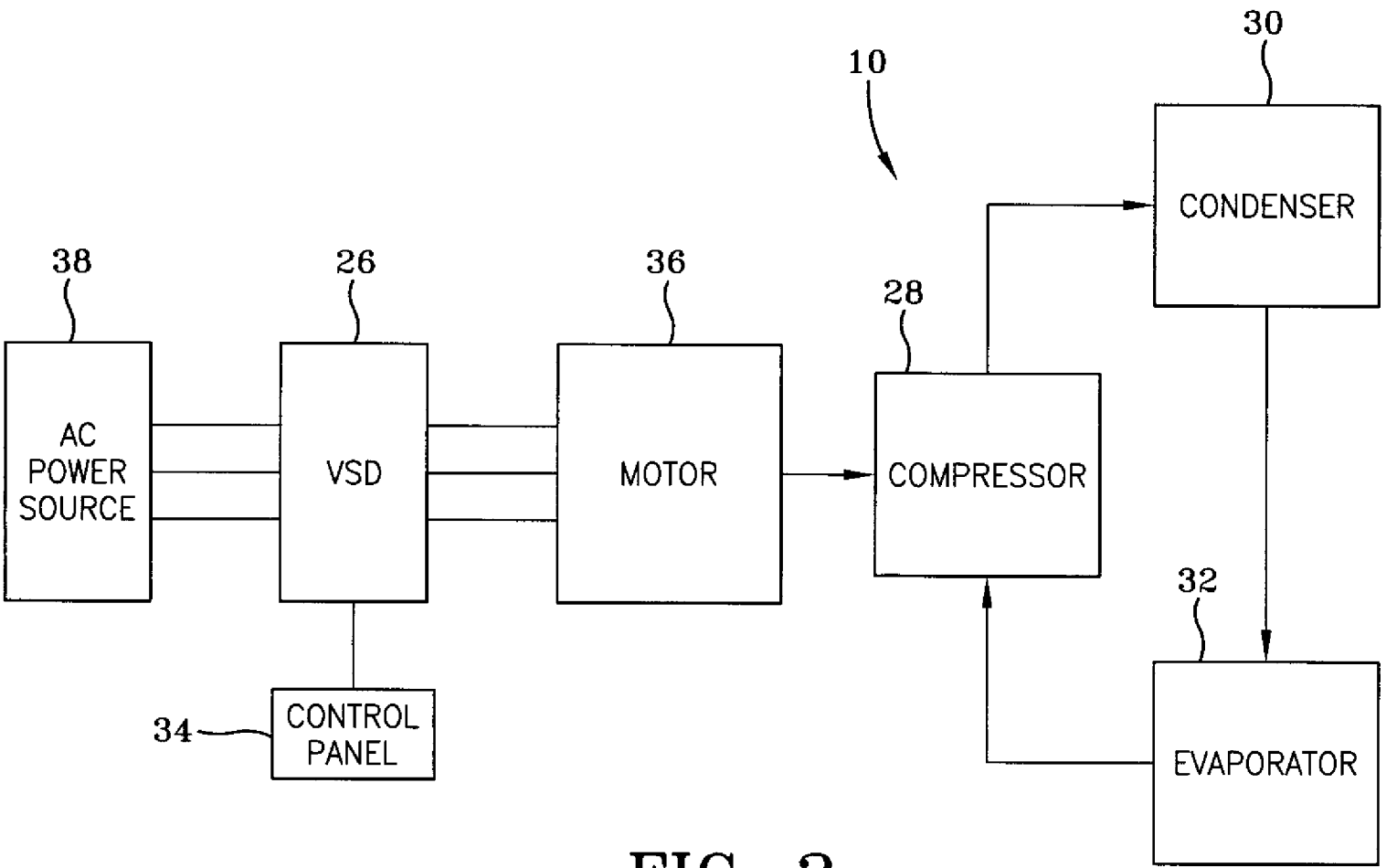
FIG. 2 schematically shows an exemplary embodiment of a vapor compression system.

FIG. 2 schematically illustrates an exemplary embodiment of system 14 with VSD 26 that may be used in building 12 in FIG. 1. System 10 may include compressor 28, a condenser 30, a liquid chiller or evaporator 32 and a control panel 34. Compressor 28 is driven by motor 36 that is powered by VSD 26. VSD 26 may be, for example, a vector-type drive or a variable-voltage, variable frequency (VVVF) drive. VSD 26 receives AC power having a particular fixed line voltage and fixed line frequency from AC power source 38 and provides AC power to motor 36 at desired voltages and desired frequencies, both of which can be varied to satisfy particular requirements. Control panel 34 can include a variety of different components, such as an analog to digital (A/D) converter, a microprocessor, a non-volatile memory, and an interface board, to control operation of system 10. Control panel 34 can also be used to control the operation of VSD 26, and motor 36.

Compressor 28 compresses a refrigerant vapor and delivers the vapor to condenser 30 through a discharge line. Compressor 28 can be any suitable type of compressor, for example, a screw compressor, a centrifugal compressor, a reciprocating compressor, or a scroll compressor. The refrigerant vapor delivered by compressor 28 to condenser 30 enters into a heat exchange relationship with a fluid, for example, air or water, and undergoes a phase change to a refrigerant liquid as a result of the heat exchange relationship with the fluid. The condensed liquid refrigerant from condenser 30 flows through an expansion device 66 to evaporator 32.

In another exemplary embodiment evaporator 32 may include connections for a supply line and a return line of a cooling load. A secondary liquid, for example, water, ethylene, calcium chloride brine or sodium chloride brine, travels into evaporator 32 via return line and exits evaporator 32 via supply line. The liquid refrigerant in evaporator 32 enters into a heat exchange relationship with the secondary liquid to lower the temperature of the secondary liquid. The refrigerant liquid in evaporator 32 undergoes a phase change to a refrigerant vapor as a result of the heat exchange relationship with the secondary liquid. The vapor refrigerant in evaporator 32 exits evaporator 32 and returns to compressor 28 by a suction line to complete the cycle.

Figure 3:
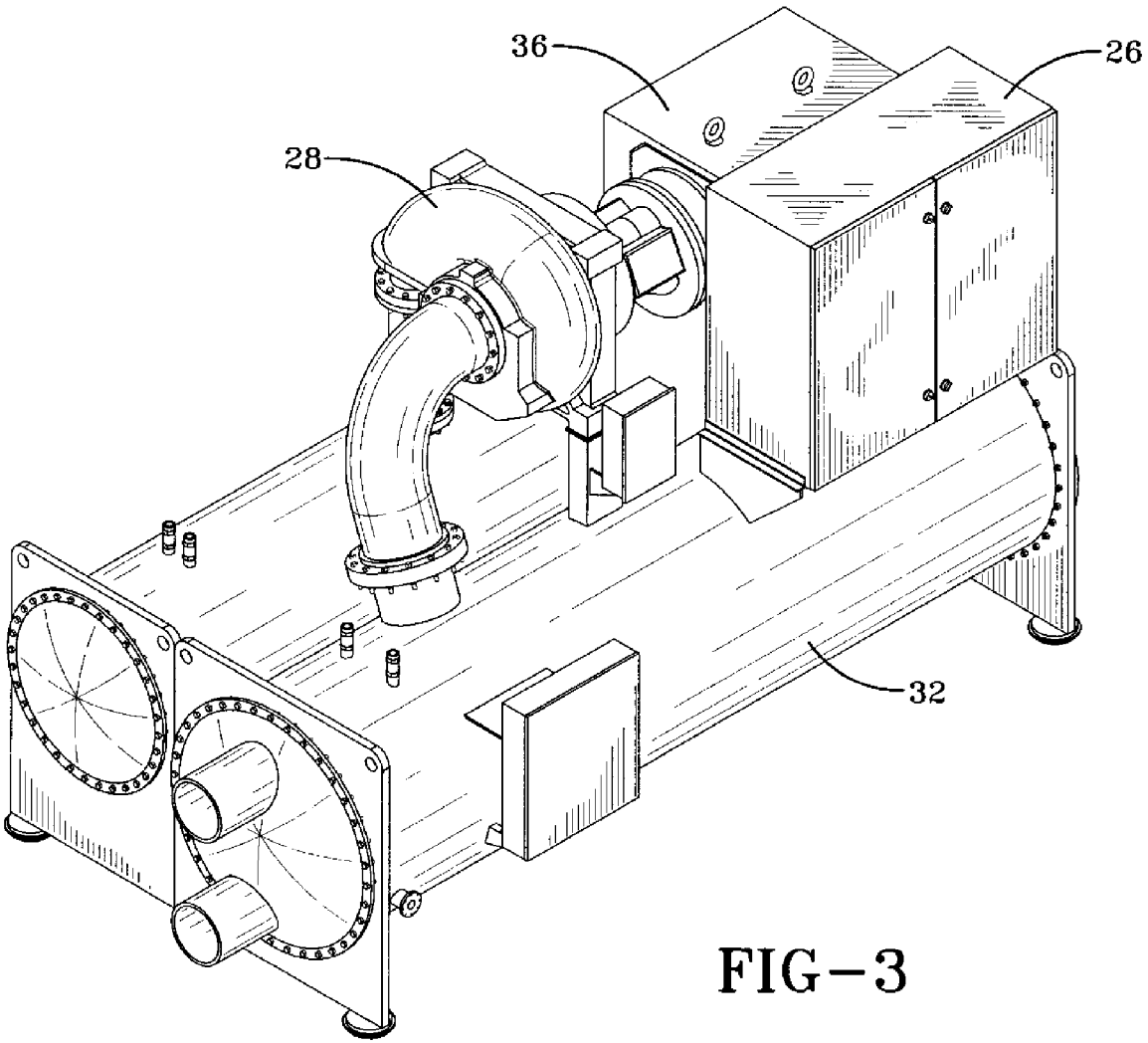
FIG. 3 shows an exemplary embodiment of a variable speed drive (VSD) mounted on a vapor compression system.

FIG. 3 shows an exemplary vapor compression system of an HVAC&R system. VSD 26 is mounted on top of the evaporator 32, and adjacent to motor 36, and control panel 34. Motor 36 may be mounted on condenser 30 on the opposite side of evaporator 32. Output wiring (not shown) from VSD 26 is connected to motor leads (not shown) for motor 36, to power motor 36, which drives compressor 28.

Referring to FIG. 1, an exemplary HVAC, refrigeration or liquid chiller system 10 includes compressor 28, condenser 30, and liquid chilling evaporator 32 connected in a refrigerant loop. In one exemplary embodiment, the chiller system has a capacity of 250 tons or greater and may have a capacity of 1000 tons or greater. Motor 36 is connected to compressor 28 to power compressor 28. Motor 36 and compressor 28 are preferably housed in a common hermetic enclosure, but can be housed in separate hermetic enclosures.

The high pressure liquid refrigerant from condenser 30 flows through an expander 66 to enter evaporator 32 at a lower pressure. The liquid refrigerant delivered to evaporator 32 enters into a heat exchange relationship with a fluid, for example, air or water, and undergoes a phase change to a refrigerant vapor as a result of the heat exchange relationship with the fluid. The vapor refrigerant in evaporator 32 exits evaporator 32 and returns to compressor 28 by a suction line to complete the cycle. It is to be understood that any suitable configuration of condenser 30 and evaporator 32 can be used in the system, provided that the appropriate phase change of the refrigerant in condenser 30 and evaporator 32 is obtained. A motor cooling loop is connected to the refrigerant loop to provide cooling to motor 36.

Figure 4:
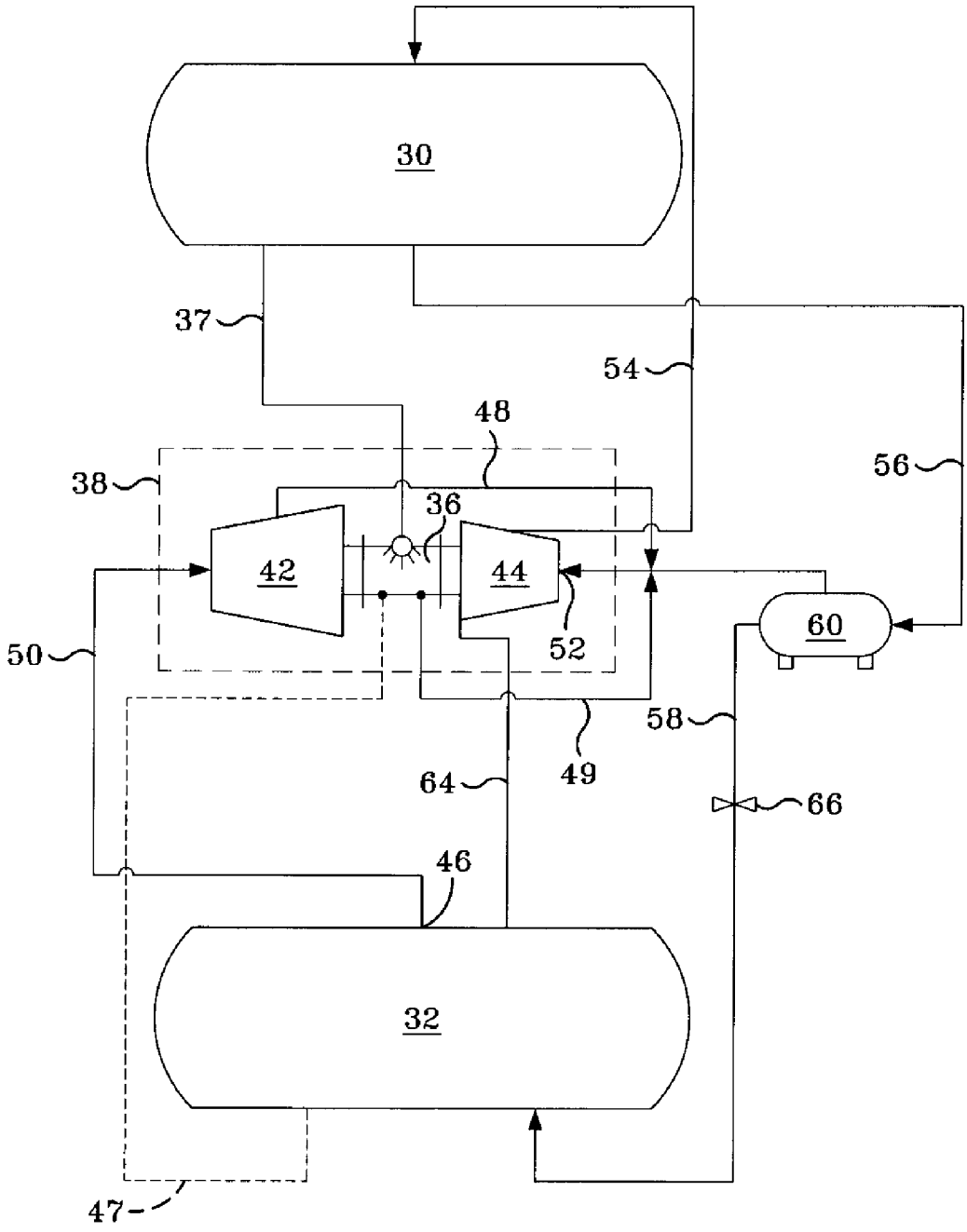
FIG. 4 schematically shows an exemplary embodiment of a cooling system for a multi-stage vapor compression system.

In FIG. 4, a multi-stage compressor system is shown. The multi-stage compressor 38 includes a first compressor stage 42 and a second compressor stage 44. First compressor stage 42 and second compressor stage 44 are disposed on opposite ends of motor 36, which drives each of compressor stages 42, 44. Vapor refrigerant is drawn into first compressor stage 42 through refrigerant line 50. Refrigerant line 50 is supplied by a discharge line 46 of evaporator 32. The vapor refrigerant is compressed by first compressor stage 42, and discharged into an interstage crossover line 48. Interstage crossover line 48 is connected at an opposite end to a suction input 52 of a second compressor stage 44. The refrigerant is further compressed in second compressor stage 44 for output to compressor discharge line 54, and supplied to condenser 30, where the pressurized vapor refrigerant is condensed into a liquid. In the exemplary embodiment shown in FIG. 4, an optional economizer circuit 60 is inserted into a liquid refrigerant return path 56, 58, and a vapor flow line 62 is connected to suction inlet 52, for providing intermediate pressure refrigerant to second compressor stage 44, to increase the efficiency of the refrigeration cycle. A source of motor cooling is provided by connecting evaporator 32 to an air gap inside motor 36 inside of hermetic or semi-hermetic compressor 38, through a second refrigerant vapor line 64. Vapor line 64 is in fluid communication with the interior of motor 36, and provides refrigerant at an intermediate pressure relative to suction inlet 52 of second compressor stage 44. The intermediate pressure may be a pressure greater than an evaporator operating pressure and less than a condenser operating pressure. In an exemplary embodiment the intermediate pressure may be approximately equal to a first compressor stage 42 discharge pressure, a second compressor stage 44 suction pressure, or an economizer operating pressure, all three of which pressures are nearly identical, with potentially slight differences due to line drop. In one embodiment, motor 36 may be vented to connect to interstage crossover line 48 or a location in fluid communication therewith, through a vent line 49. The venting connection determines the intermediate pressure level of motor cavity 78 (FIG. 5).

In an alternate embodiment, motor 36 may be vented to evaporator 32 through alternate vent line 47, and vent line 49 removed from FIG. 4. Alternate vent line 47 may be used, for example, in the case where a perfect or nearly perfect seal can be achieved between compressor stages 42, 44 and motor cavity 78 (FIG. 5); in such a case a minimum loss will correspond with a minimum pressure within motor cavity 78, the minimum loss realizable by venting to evaporator 32 through alternate vent line 47. Also, in the case of a single stage compressor 38, motor 36 and motor cavity 78 may be cooled by the above-described method, by venting motor 36 to evaporator 32.

Figure 5:
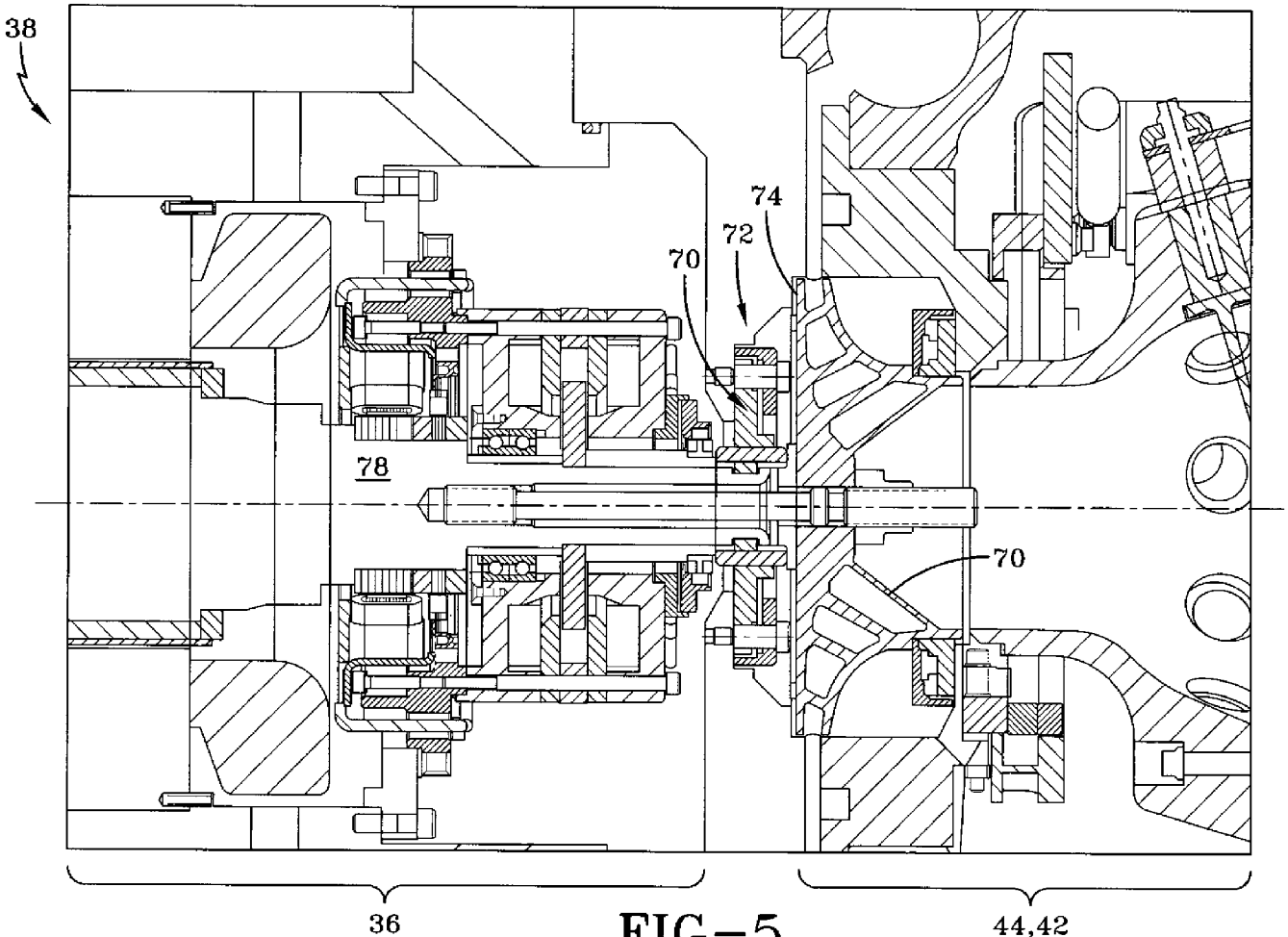
FIG. 5 shows an exemplary embodiment of a balance piston labyrinth seal in the compressor.

Referring next to FIG. 5, a partial sectional view of multistage compressor 38 shows an interface 72 between motor 36 and first compressor stage 42 or second compressor stage 44, compressor 38 being generally symmetrical about either interface 72. A seal 70 is disposed between motor 36 and first compressor stage 42. Another seal 70 is disposed between motor 36 and second compressor stage 44. Leakage paths occur for the balance piston labyrinth seals 70 of first compressor stage 42 and second compressor stage 44. The pressure in a compressor stage cavity 74, upstream of seal 70, is approximately the same as each impeller 76 discharge static condition, respectively. A motor cavity 78 located downstream of seal 70 is pressurized at motor cavity 78 conditions—that is, motor cavity pressure approximately equals the evaporator pressure when vapor from evaporator 32 is used to cool the rotor. The vapor from evaporator 32 is vented back through first compressor stage 42 suction through refrigerant vapor line 64.

Figure 6:
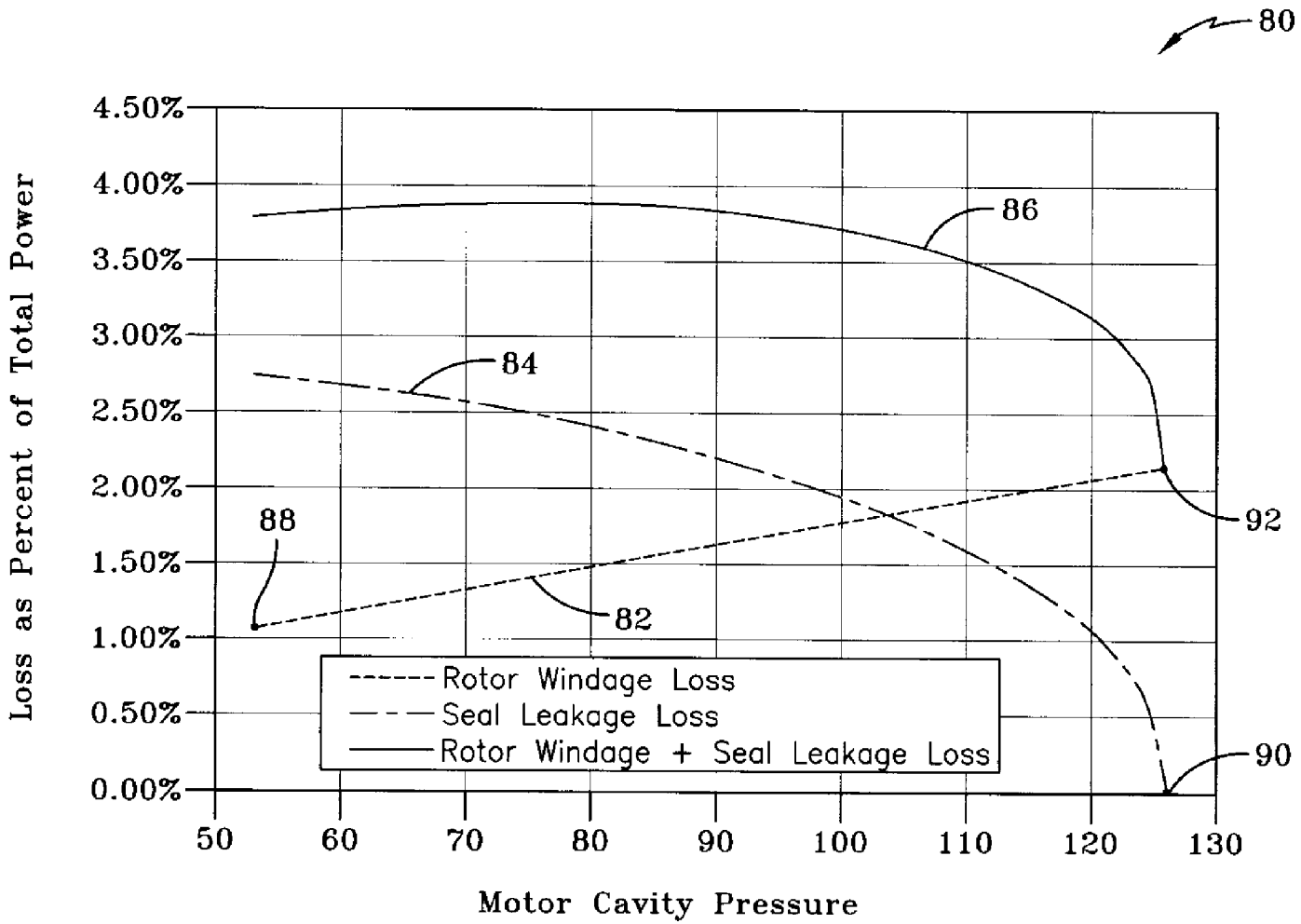
FIG. 6 shows a graph of windage loss, seal leakage loss and combined losses as a function of the motor cavity pressure.

FIG. 6 depicts approximate theoretical losses for windage and seal leakage as a function of motor cavity pressure for a representative compressor. The motor cavity pressure shown in the x-axis was varied between evaporator conditions and condenser conditions to generate the curves. A graph 80 represents the seal leakage power losses 84, rotor windage power losses 82, and the combined power losses 86 in the motor, as functions of motor cavity pressure versus percentage of total power. Combined power loss, line 86, is the sum of the seal leakage power loss and the rotor windage power loss. A minimum power that is lost due to rotor windage occurs at a point 88, which corresponds to the lowest motor cavity pressure. Point 88 occurs at approximately evaporator pressure conditions, within motor 36. Conversely, a point 90 at which the minimum power is lost due to seal leakage occurs when the pressure differential across the seal is approximately zero. Point 90 at which there is approximately zero pressure differential across the seal coincides with high motor cavity pressure. In the exemplary graph 80, the internal motor cavity pressure is approximately 126 PSI.

A point 92 at which minimum compressor system power loss, or combined power loss, occurs is the point at which the resultant sum of the seal leakage loss and the rotor windage loss is minimized, as shown by line 86. This combined power loss minimum point 92 occurs at high motor cavity pressure. This result is contrary to the result that is yielded when considering rotor windage loss only, that is, considering rotor windage loss without regard to seal leakage, the rotor windage loss is minimized at the lowest motor cavity pressure.

Graph 80 illustrates that to minimize combined compressor system losses 86, seal leakage losses 82 must be minimized or reduced. This can be achieved by, for example, improved seals that reduce leakage, and by minimizing the differential pressure across the seal. In one exemplary embodiment, differential pressure across the seal may be minimized by using sources of motor cooling flow and venting that are as nearly equal in pressure as possible.

One method of minimizing the differential pressure across seal 70 is to use high pressure vapor, which exceeds evaporator 32 vapor pressure, to cool motor cavity 78 to achieve minimum system losses. In one exemplary embodiment, the method employs liquid refrigerant from condenser 30 expanded to pure vapor to provide rotor gap cooling, as indicated by coolant supply line 37 (FIG. 4), and venting back to an intermediate pressure location, for example, second stage suction inlet 52, first stage discharge or interstage cross-over line 48, or economizer vessel 60. Other intermediate pressure locations may also be used, and the locations cited in the preceding sentence are given by way of example and not limitation. Those skilled in the art will appreciate that intermediate pressure locations may be found throughout the refrigerant circuit, and the examples given are generally accessible points in a refrigerant circuit.

In another exemplary embodiment, instead of implementing dedicated cooling lines with minimized pressure differential across the barrier seal, the system may utilize seal leakage flow only from stage two, through the motor cavity and into stage one, without separate cooling sources from another part of the system. This method reduces system complexity and costs. In either case, maintenance of motor and bearing operating temperature within required limits is ensured.

The disclosed cooling methods may be applied to various types of motors, for example, induction, permanent magnet, hybrid permanent magnet, solid rotor motors, implemented in a hermetic/semi-hermetic environment, within the respective motor operating limits. In addition, this applies to various bearing types, for example, oil film, gas or foil, rolling element, magnetic, and other suitable bearings, within the respective bearing operating limits.

The optimum operating pressure for motor cavity 78 may vary between types of seals having different characteristics, and the resultant seal leakage may differ accordingly.

It is important to note that the construction and arrangement of the method and system for rotor cooling as shown in the various exemplary embodiments is illustrative only. Although only a few exemplary embodiments have been described in detail in this disclosure, those skilled in the art who review this disclosure will readily appreciate that many modifications are possible (for example, variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

The invention claimed is:

1. A vapor compression system comprising:

a compressor, an evaporator and a condenser connected in a closed loop;

a motor connected to the compressor to power the compressor;

a motor coolant system configured to cool the compressor motor;

the compressor comprising:

a first compressor stage and a second compressor stage, the first compressor stage providing compressed vapor to an input of the second compressor stage;

the motor coolant system comprising:

a first connection in fluid communication with the condenser to deliver refrigerant into a motor cavity, and a second connection with the refrigerant loop to return refrigerant to an interstage connection having an intermediate pressure, the intermediate pressure greater than an evaporator operating pressure and less than a condenser operating pressure; and a first seal located between the motor cavity and the first compressor stage, and a second seal located between the motor cavity and the second compressor stage, the first and second seal configured to maintain the refrigerant at an intermediate pressure inside the motor cavity.

2. The system of claim 1, wherein the first connection receives the refrigerant from the condenser at a pressure greater than the intermediate pressure.

3. The system of claim 1, wherein the intermediate pressure is approximately equal to a first compressor stage discharge pressure, a second compressor stage suction pressure, or an economizer operating pressure.

4. The system of claim 1, wherein the motor is positioned between the first compressor stage and the second compressor stage.

5. The system of claim 4, wherein the refrigerant from the condenser provides a high pressure vapor exceeding an evaporator vapor pressure to reduce a differential pressure across the first and second seal to cool motor cavity to reduce system losses and to reduce leakage of refrigerant between the motor cavity and the second compressor stage.

6. The system of claim 5, wherein the refrigerant from the condenser is expanded to pure vapor in the motor cavity to provide rotor gap cooling.

7. The system of claim 1, wherein vapor refrigerant is drawn into the first compressor stage through a refrigerant line in fluid communication with the evaporator.

8. The system of claim 1, wherein vapor refrigerant is compressed by the first compressor stage and discharged into an input of the second compressor stage.

9. The system of claim 6, wherein the vapor refrigerant is received in the second compressor stage and further compressed, and the vapor refrigerant flows from an output of the second compressor stage to the condenser.

10. The system of claim 1, wherein the system further comprises an economizer circuit connected between the condenser and the evaporator, the economizer circuit comprising:

a flow line in fluid communication with an inlet in the second compressor stage for providing vapor refrigerant to the second compressor stage.

11. The system of claim 1, wherein the motor cavity is in fluid communication with an interstage location between the first stage compressor discharge and the second stage suction inlet through a second flow line.

12. A motor coolant system for a motor powering a compressor in a chiller system, the chiller system comprising a compressor, an evaporator and a condenser connected in a closed loop, the motor coolant system comprising:

a motor housing enclosing the motor, and a motor cavity within the motor housing;

the coolant system comprising a first connection from the motor cavity in fluid communication with the condenser to deliver a refrigerant into the cavity, and a second connection from the motor cavity in fluid communication with the loop to return refrigerant to an interstage connection having an intermediate pressure, the intermediate pressure greater than an evaporator operating pressure and less than a condenser operating pressure; and the motor cavity configured to maintain the refrigerant at the intermediate pressure inside the motor cavity.

13. The system of claim 12, the compressor further comprising:

a first compressor stage and a second compressor stage;

a first seal located between the motor cavity and the first compressor stage, and a second seal located between the motor cavity and the second compressor stage, the first seal and the second seal configured to maintain the refrigerant at an intermediate pressure inside the motor cavity;

wherein the pressure inside the motor cavity may be adjusted to approximately a first compressor stage discharge pressure, a second compressor stage suction pressure, or an economizer operating pressure.

14. The system of claim 12, wherein the system further comprises an expander connected between the condenser and the evaporator.

15. The system of claim 12, wherein the motor cavity receives liquid refrigerant from the condenser through a supply line, and vapor refrigerant is vented back to the closed loop at the intermediate pressure.

16. The system of claim 12, wherein the motor cavity is cooled by seal leakage flow of refrigerant from the second stage compressor discharge through the motor cavity and into the first stage compressor.

17. The system of claim 12, wherein the motor is an induction motor, a permanent magnet motor, a hybrid permanent magnet motor, or a solid rotor motor.

18. The system of claim 12, wherein the compressor further comprises bearings, and the bearings are oil film bearings, gas bearings, foil bearings, rolling element bearings, or magnetic bearings.

19. A motor coolant system for a motor powering a compressor in a chiller system, the chiller system comprising a compressor, an evaporator and a condenser connected in a closed loop, the motor coolant system comprising:

a motor housing enclosing the motor, and a motor cavity within the motor housing;

the coolant system comprising a first connection from the motor cavity in fluid communication with the condenser to deliver a refrigerant into the cavity, and a second connection from the motor cavity in fluid communication with the loop to return refrigerant to the evaporator having a predetermined operating pressure, and the motor cavity configured to maintain a refrigerant pressure greater than the evaporator operating pressure inside the motor cavity.

* * * * *